US007992753B2

(12) United States Patent
Edwards

(10) Patent No.: US 7,992,753 B2
(45) Date of Patent: Aug. 9, 2011

(54) SPOOL-SUPPORTED BAG DISPENSER

(75) Inventor: Timothy Edwards, Del Mar, CA (US)

(73) Assignee: RPG Bags, LLC, Irving, TX (US)

( * ) Notice: Subject to any disclaimer, the term of this patent is extended or adjusted under 35 U.S.C. 154(b) by 1593 days.

(21) Appl. No.: 11/007,426

(22) Filed: Dec. 7, 2004

(65) Prior Publication Data

US 2006/0118588 A1 Jun. 8, 2006

(51) Int. Cl.

| | |
|---|---|
| ***B26F 3/02*** | (2006.01) |
| ***B65H 16/02*** | (2006.01) |
| ***B65H 19/00*** | (2006.01) |
| *A01K 23/00* | (2006.01) |

(52) U.S. Cl. ..... 225/106; 225/46; 225/93; 119/174; 206/407; 242/599.1; 294/1.3

(58) Field of Classification Search ..... 225/39–47, 225/77, 93, 106; 242/578.2, 597.1, 597.2, 242/597.3, 597.4, 597.7, 597.8, 599.1, 598.1; 119/161, 174, 867–869, 795, 796; 206/403–406, 206/407, 409

See application file for complete search history.

(56) References Cited

U.S. PATENT DOCUMENTS

| | | | | | |
|---|---|---|---|---|---|
| 643,089 | A * | 2/1900 | Gurney | 242/423.2 |
| 2,494,376 | A * | 1/1950 | Coon | 242/597.1 |
| 2,759,545 | A * | 8/1956 | Rizza | 225/34 |
| 3,342,436 | A * | 9/1967 | Wattenford | 242/134 |
| 3,822,837 | A * | 7/1974 | Celebonovic | 242/573.5 |
| 4,111,089 | A * | 9/1978 | Montaruli | 83/542 |
| 4,884,734 | A * | 12/1989 | Kahl et al. | 225/26 |
| 5,167,377 | A * | 12/1992 | Chalmers | 225/46 |
| 5,454,500 | A * | 10/1995 | Chen | 225/46 |
| 6,076,717 | A | 6/2000 | Edwards et al. | |
| 6,223,695 | B1 | 5/2001 | Edwards et al. | |
| 6,240,881 | B1 | 6/2001 | Edwards et al. | |
| 7,124,976 | B1 * | 10/2006 | DeVincenzo | 242/423.1 |

* cited by examiner

*Primary Examiner* — Clark F. Dexter

(74) *Attorney, Agent, or Firm* — Locke Lord Bissell & Liddell, LLP

(57) ABSTRACT

A bag dispenser includes an axle having a plurality of spaced-apart interior annular rings. A roll of bags are wound about the axle and a rod is insertable into the axle. When inserted into the axle, the rod engages at least one of the annular rings to connect the rod to the axle.

4 Claims, 7 Drawing Sheets

SPOOL-SUPPORTED BAG DISPENSER

BACKGROUND OF THE INVENTION

The present invention relates in general to devices for collecting animal litter. More particularly, the present invention relates to a dispenser of bags for collecting animal litter.

The rapid increase of urban population coupled with the increasing popularity of dogs and other pets has created a serious sanitary problem in connection with the disposal of animal litter, and particularly canine litter. Because many animal pet owners have permitted their animals to deposit solid excrement on both private and public property, a number of communities have enacted ordinances requiring pet owners, under penalty of fine, to retrieve and dispose of litter created by their pets.

It has been found that the willingness of pet owners to retrieve and properly dispose of animal litter is related to the ease, convenience and economy with which the litter may be handled in a clean and sanitary manner. While a number of devices have been proposed for the purpose of disposing of animal litter, they have suffered from various shortcomings. Some devices are not completely disposable and, therefore, require some degree of cleanup. Other types of devices, both of the disposable and reusable varieties, are awkward and/or conspicuous to carry. Moreover, some prior animal litter collection devices are too expensive for everyday use.

One commonly accepted method for collecting and storing animal litter until a proper disposal site can be found involves the use of a disposable plastic bag. Some pet owners will simply place a plastic bag, such as a plastic grocery bag, in a clothing pocket for retrieval when needed. This method of collecting animal litter presupposes, however, that the pet owner will always have access to and remember to grab a plastic bag prior to walking the pet. There have been proposals to provide devices which would store plastic bags within a container that may be worn by the owner or the pet. Each of these prior devices, however, suffers several disadvantages which the present invention is intended to overcome.

The retractable leash has been gaining popularity for the last twenty years and has taken its place as a permanent pet product. Some have recognized the desirability of providing an easy way to carry pet waste cleanup bags when going for a walk utilizing such a retractable leash. For example, U.S. Pat. No. 5,540,469 discloses a retractable leash placed into an animal waste collecting device which incorporates its own handle, bag holder and flashlight. It is believed, however, that such an assembly involves apparatus and associated costs which are undesirable.

Accordingly, there is a need for a bag dispenser which provides access to bags when needed. There is a further need for a bag dispenser which provides access to a roll of plastic bags when needed. There is an additional need for a bag dispenser which can be used with or without a housing. There is also a need for a bag dispenser that is modular to increase the ease of replacing an exhausted roll of bags. The present invention fulfills these needs and provides other related advantages.

SUMMARY OF THE INVENTION

The present invention discloses a bag dispenser which provides access to bags when needed. The present invention further discloses a bag dispenser which provides access to a roll of plastic bags when needed. The present invention additionally discloses a bag dispenser which can be used with or without a housing. The present invention also discloses a bag dispenser that is modular to increase the ease of replacing an exhausted roll of bags. The bag dispenser provides bags for a variety of purposes including, without limitation, the collection of animal waste.

A bag dispenser embodying the present invention includes an axle having a plurality of spaced-apart interior annular rings and a roll of bags wound about the axle. A rod is insertable into the axle and is able to engage at least one of the annular rings to connect the rod to the axle. A stop allows the rod to selectively engaging a selected one of the annular rings. The engagement of the rod and axle permits the axle to rotate about the rod. The rod is also able to selectively disengage from the annular rings of the axle in order to disconnect the rod from the axle.

The rod includes a base shaft, a resilient lever, and the stop which extends from one side of the resilient lever. As noted above, the stop automatically engages at least one of the annular rings as the rod is inserted into the axle.

The bag dispenser further includes a flange at one end of the rod. The flange has a bracket for retaining an end of the resilient lever which engages the axle.

In another embodiment of the present invention, the bag dispenser also includes a housing defining an inner cavity. The housing has an aperture therethrough permitting access to the inner cavity. A cap is attached to the rod for positioning the roll of bags centrally within the housing. The cap snap-fits to an open end of the housing.

A bag roll retainer is connected to an end of the axle opposite the cap. The bag roll retainer includes an axle guide extending into the axle. The axle and bag roll retainer are removably connected.

The cap includes a flange having a central slot, and the rod extends through the central slot and includes a retaining flange for retaining the engaging means in abutting relation to the cap flange. The cap also includes at least one bracket extending outwardly therefrom for connecting the bag dispenser to a leash.

In an additional embodiment of the present invention, the bag dispenser includes a generally planar bar having an elongated slot through which the bags are individually removable from the roll, and first and second bag roll retaining flanges. The bar extends between the first and second bag roll retaining flanges in spaced relation to the axle. The bag dispenser also includes a guide for limiting radially outward expansion of the roll of bags as the roll of bags unwinds.

The roll of bags is adhesively connected to the axle. One side of each bag includes a releasable dry adhesive for adhering to another side of at least one bag in the roll of bags.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
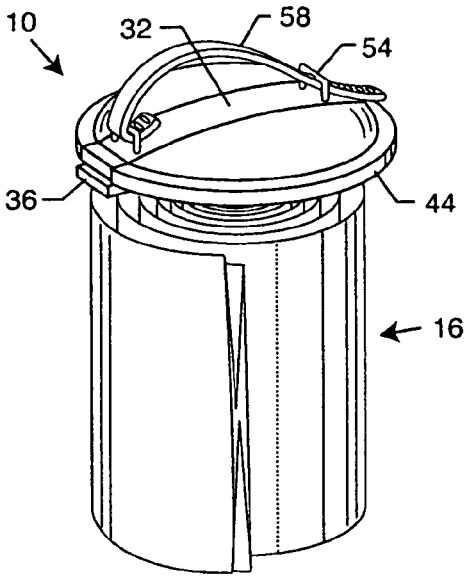
FIG. 1 is a front perspective view of a bag dispenser embodying the present invention.
Figure 2:
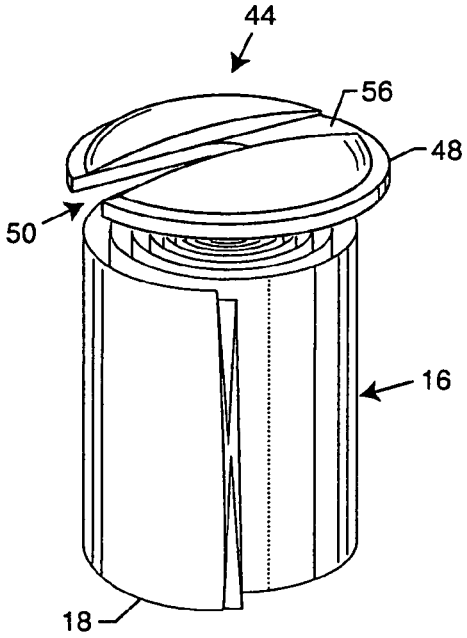
FIG. 2 is a front perspective view of the lid and roll of bags of FIG. 1.
Figure 3:
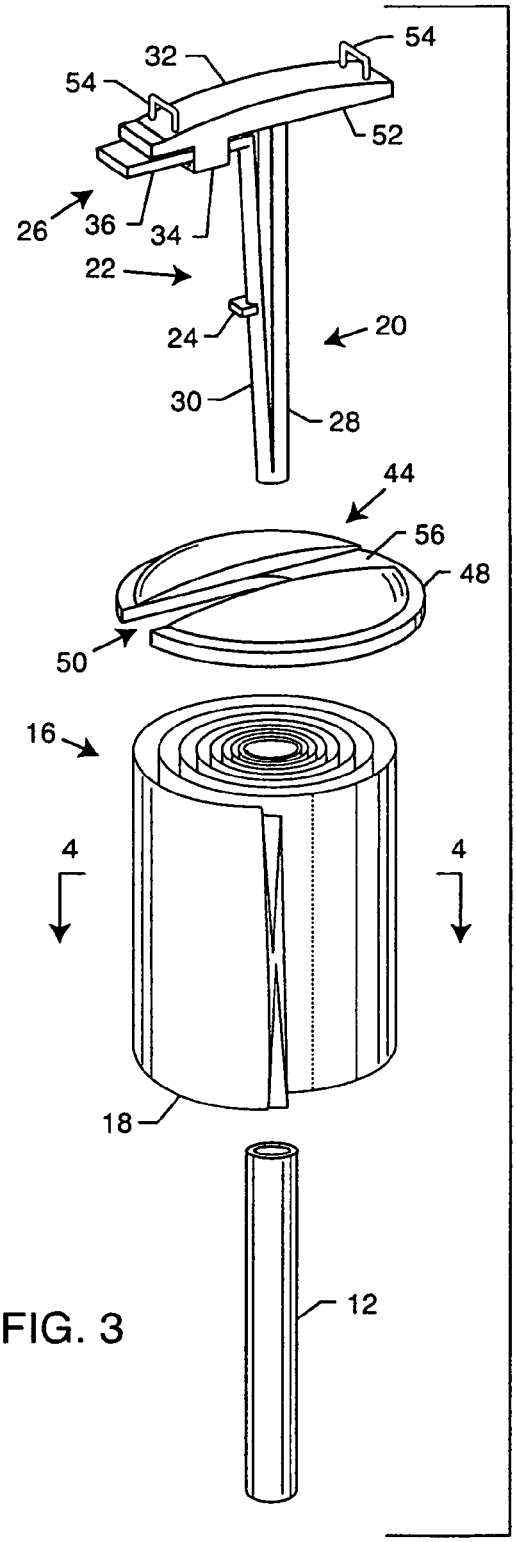
FIG. 3 is an exploded front perspective view of the bag dispenser of FIG. 1.
Figure 4:
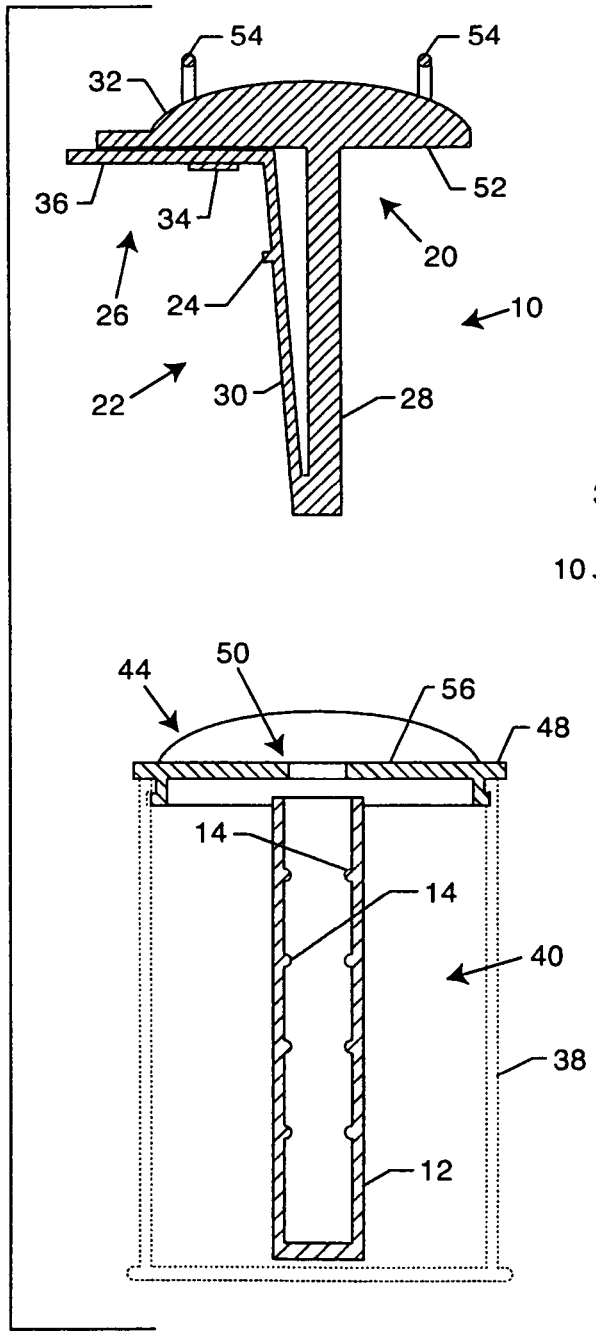
FIG. 4 is an exploded side elevational view of the bag dispenser of FIG. 1 shown with a housing in phantom lines but without the roll of bags.
Figure 5:
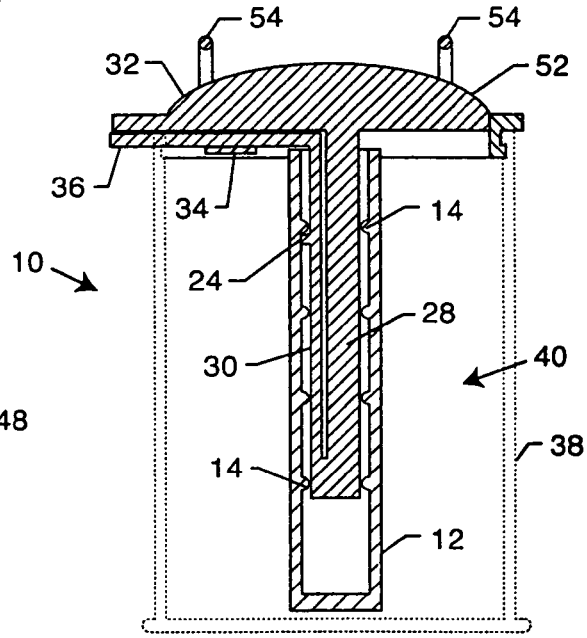
FIG. 5 is a side elevational view of the bag dispenser of FIG. 4 illustrating the interior of the bag dispenser, the lid of unitary construction with a rod engaging an axle and the lid covering a housing shown in phantom lines.
Figure 6:
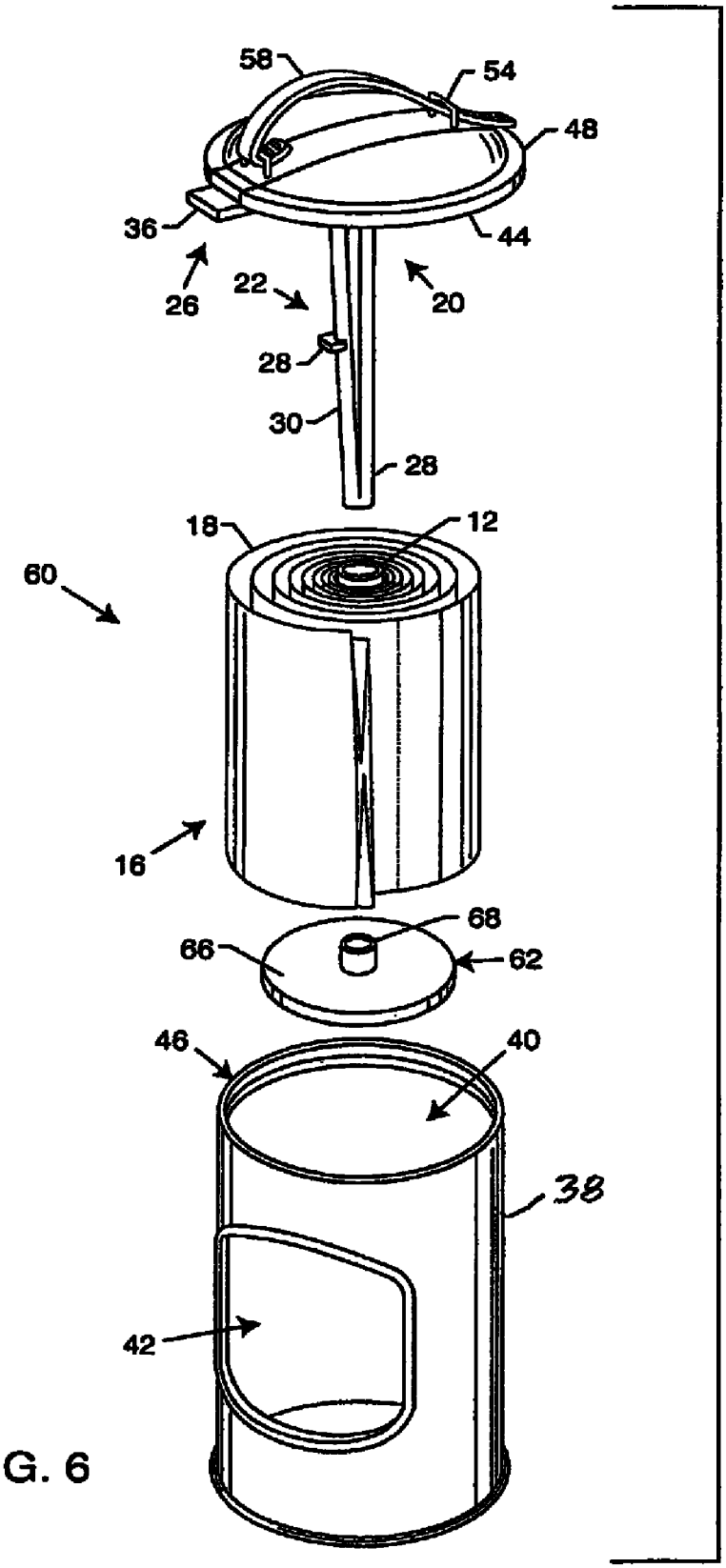
FIG. 6 is an exploded front perspective view of another bag dispenser embodying the present invention.
Figure 7:
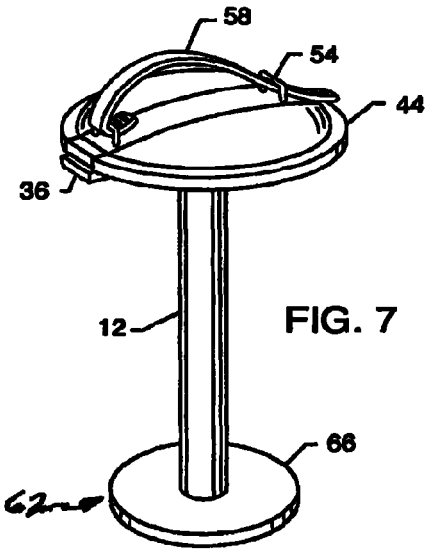
FIG. 7 is a front perspective view of the bag dispenser of FIG. 6 shown without the housing and without the bags.
Figure 8:
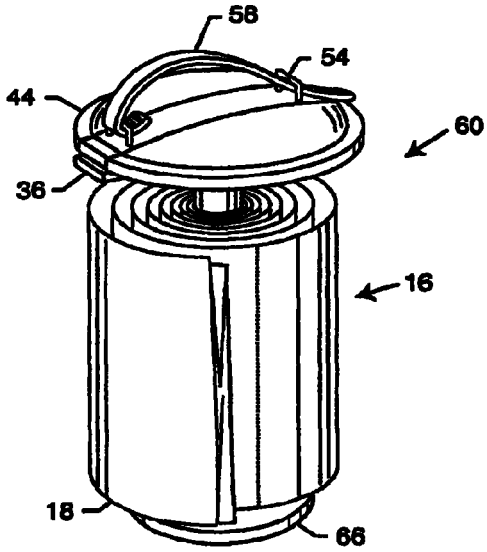
FIG. 8 is a front perspective view of the bag dispenser of FIG. 7 shown with the bags.
Figure 9:
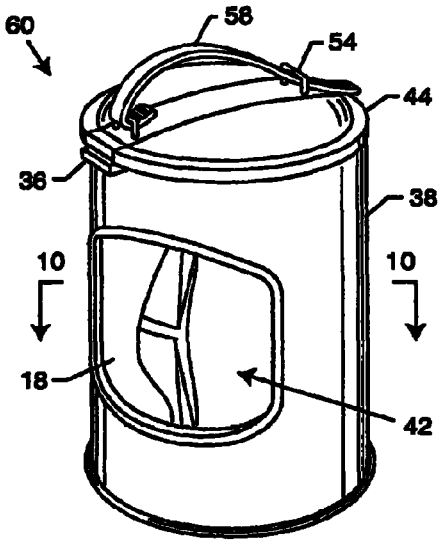
FIG. 9 is a front perspective view of the bag dispenser of FIG. 6.
Figure 10:
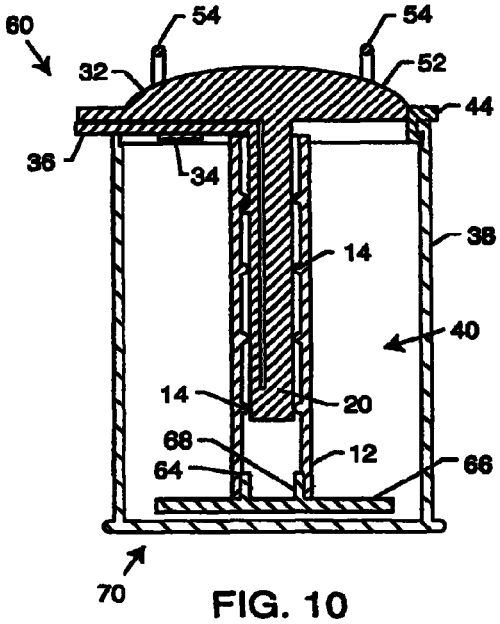
FIG. 10 is a cross-sectional side elevational view of the bag dispenser of FIG. 6, taken along line 10-10 of FIG. 9, shown without the bags.
Figure 11:
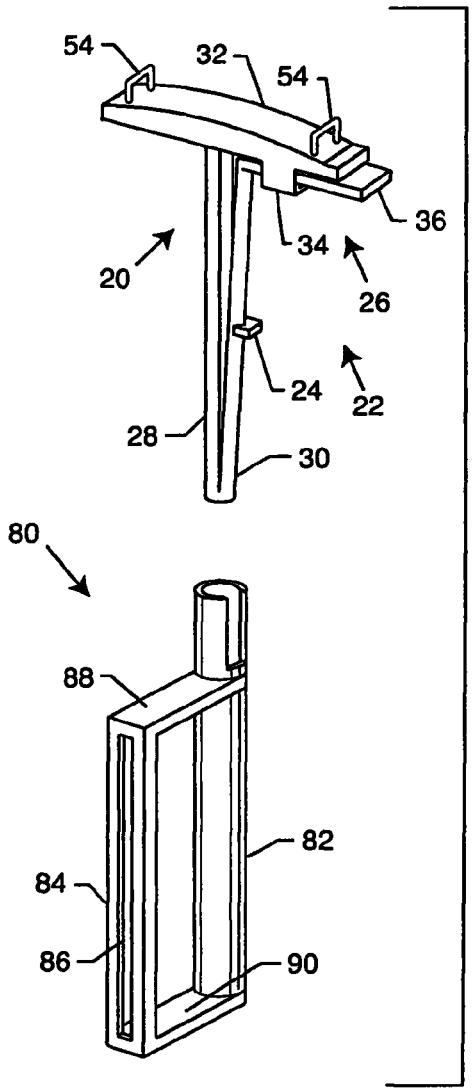
FIG. 11 is an exploded front perspective view of an additional bag dispenser embodying the present invention.
Figure 12:
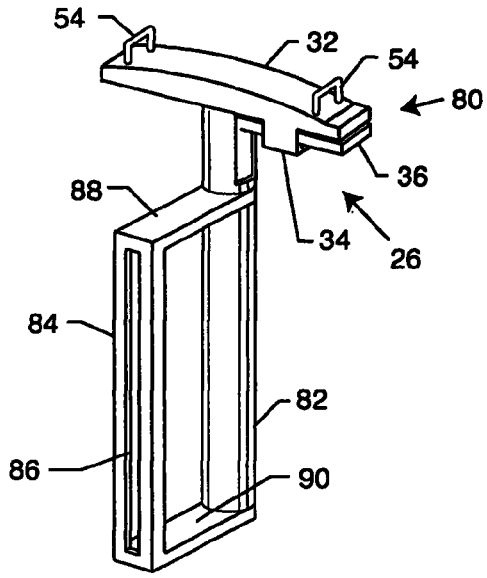
FIG. 12 is an front perspective view of the bag dispenser of FIG. 11.
Figure 13:
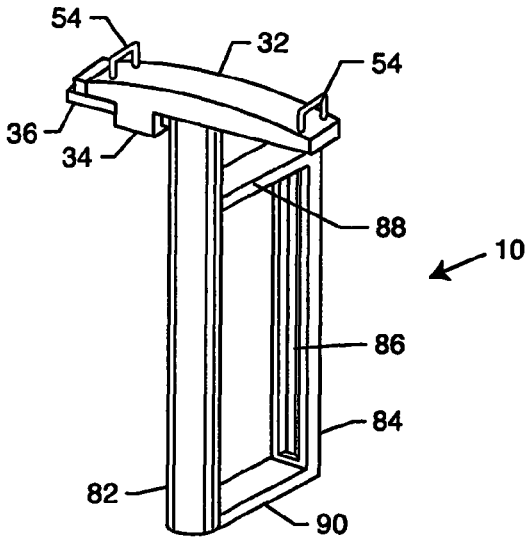
FIG. 13 is a rear perspective view of the bag dispenser of FIG. 11.
Figure 14:
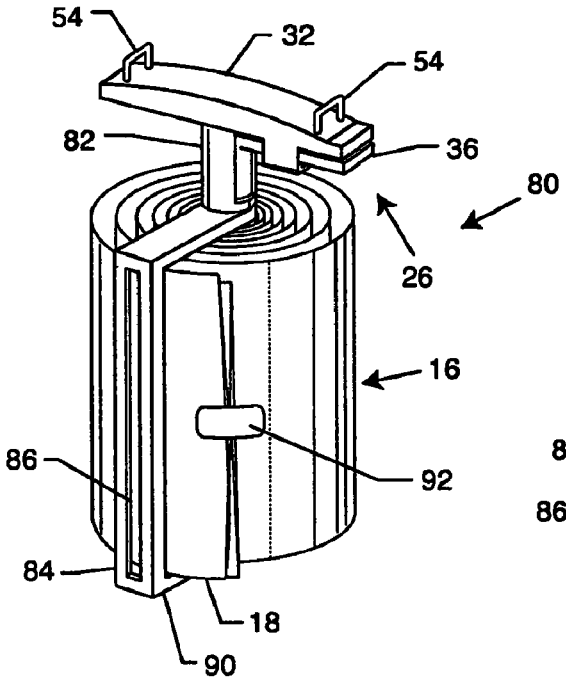
FIG. 14 is a front perspective view of the bag dispenser of FIG. 12 shown with an unopened roll of bags.
Figure 15:
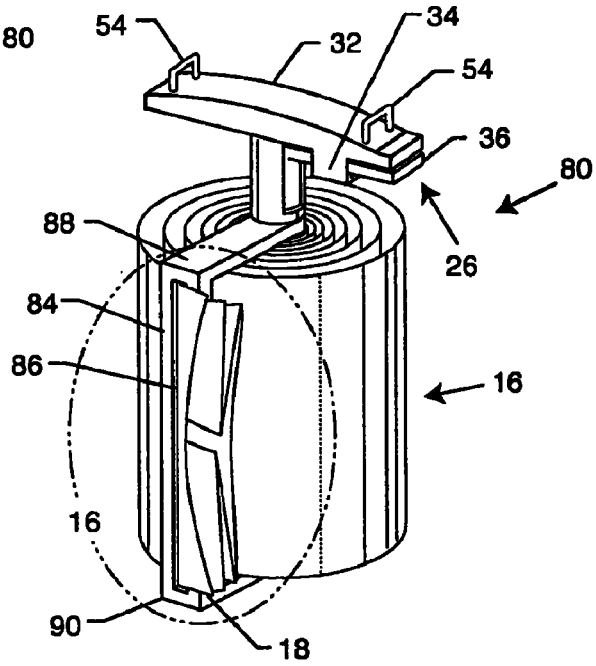
FIG. 15 is a front perspective view of the bag dispenser of FIG. 14 shown with the roll of bags threaded through an elongated dispensing slot.
Figure 16:
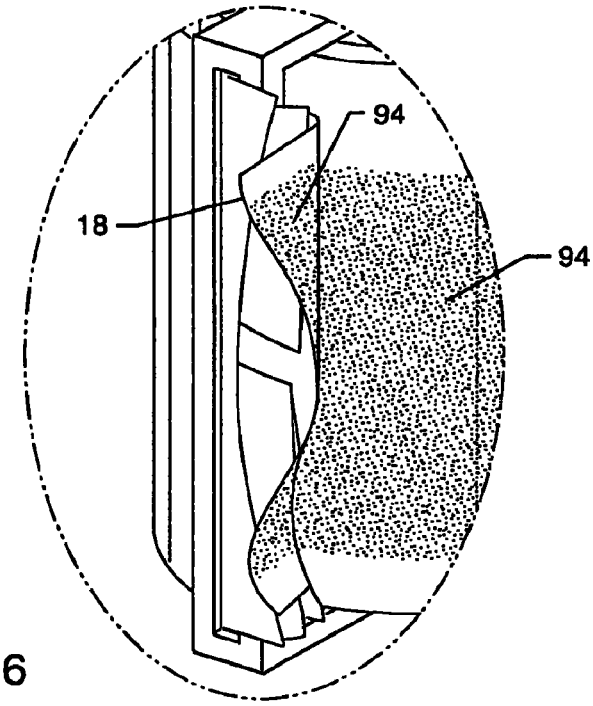
FIG. 16 is a cutaway front perspective view of the bag dispenser of FIG. 15 taken along line 16 of FIG. 15 illustrating adhesive that holds the bags on the roll.

As shown in FIGS. 1-18 for purposes of illustration, the present invention resides in a spool-supported bag dispenser 10, 60, 80, 100.

A bag dispenser 10 embodying the present invention, illustrated in FIGS. 1-5, includes a tubular axle 12 having a plurality of spaced-apart interior annular rings 14 and a roll 16 of a plurality of plastic bags 18 which are connected end-to-end and wound about the axle 12. A rod 20 is insertable into the axle 12 and includes means for engaging 22 at least one of the annular rings 14 to connect the rod 20 to the axle 12. The engaging means 22 includes a stop 24 that allows the rod 20 to selectively engage a selected one of the annular rings 14. The stop 24 is a generally rectangular shelf that extends from the rod 20. The engagement of the rod 20 and axle 12 permits the axle 12 to rotate about the rod 20 as the selected annular ring 14 moves along a top surface of the stop 24 as the axle 12 rotates. The rod 20 also includes means for selectively disengaging 26 from the annular rings 14 of the axle 12 in order to disconnect the rod 20 from the axle 12.

The rod 20 includes a base shaft 28 and an L-shaped resilient lever 30. The resilient lever 30 is of unitary construction with the base shaft 28 but splits from the base shaft 28 at the lower portion of the rod 20. The stop 24 extends from one side of the resilient lever 30. The engaging means 22 functions by the stop 24 automatically engaging at least one of the annular rings 14 as the rod 20 is inserted into the axle 12.

The means for selectively disengaging 26 the rod 20 from the axle 12 includes a flange 32 at one end of the rod 20. The flange 32 has a bracket 34 for retaining an end 36 of the resilient lever 30 which extends away from the portion of the resilient lever 30 which engages the axle 12. The rod 20 is disengaged from the axle 12 when the end 36 of the resilient lever 30 is biased towards the axle 12. This causes the stop 24, which is part of the resilient lever 30, to move towards the center of the axle 12 and away from the annular ring 14 the stop 24 had been engaged with. Disengaging the stop 24 from the annular ring 14 allows the rod 20 to be removed from the axle 12.

The bag dispenser 10 also includes a generally cylindrical housing 38 defining an inner cavity 40 for holding therein the roll 16 of plastic bags 18. The housing 38 has an aperture 42 in a sidewall of the housing 38 which permits access to the inner cavity 40. The roll 16 of plastic bags 18 is disposed within the inner cavity 40 of the housing 38 such that the bags 18 may be individually removed therefrom through the aperture 42 in the housing 38. The roll 16 of plastic bags 18 may be inserted into and disposed within the inner cavity 40 through an upper open end 46 of the housing 38.

A cap 44 is attached to the rod 20 to form a lid for covering the housing 38 and positioning the roll 16 of bags 18 centrally within the housing 38. The cap 44 encloses the upper open end 46 of the housing 38. As shown, the cap 44 snap-fits onto the open upper end 46 of the housing 16. The cap 44 includes a generally circular flange 48 having a central slot 50. The rod 20 extends through the central slot 50 and includes a retaining flange 52 for retaining the engaging means 22 in abutting relation to a shelf 56 of the cap flange 48. The cap 44, in combination with the rod, also includes two loops or brackets 54 extending upwardly and outwardly therefrom for connecting the bag dispenser 10 to a leash (not shown) or the like. A tie 58 or the like is placed through the brackets 54 to securely affix the dispenser 10 to the leash device or the like. In the alternative, the cap 44 and rod 20 may be of unitary construction.

In another embodiment of the present invention, FIGS. 6-10 illustrate a bag dispenser 60, similar to the bag dispenser 10 described above, but including a bag roll retainer 62 that engages the axle 12 and is rotatable relative to the housing 38. The bag roll retainer 62 is removably connected to an end 64 of the axle 12 opposite the cap 44. The bag roll retainer 62 is a generally disk-shaped flange 66 that includes an axle guide 68 extending upwardly from an upper surface of the flange 66. The axle 12 and bag roll retainer 62 are removably connected as the axle guide 68 extends into a lower portion of the interior of the axle 12 where the axle guide 68 is frictionally retained by the interior surface of the axle 12. The axle guide 68 is shaped to conform with the shape of the interior of the lower portion of the axle 12. For example, the axle guide 68 is generally circular (FIG. 10) to match the circular shape of the interior of the axle (FIG. 10) and sized so as to be frictionally retained therein. This results in the bag roll retainer 62 rotating in the same direction as the axle 12 when the axle 12 rotates. The bag roll retainer 62 is disposed adjacent to a cylindrical base 70 of the housing 38. The connection of the bag roll retainer 62 to the end 64 of the axle 12 prevents movement of the roll 16 of bags 18 past the end 64 of the axle 12 and contact with the base 70 of the housing 38. In this manner, the axle 12 is rotatable relative to both the cap 44 and the base 70 of the housing 38 as the ends of the axle 12 are securely yet rotatably retained centrally within the inner cavity 40 of the housing 38.

In FIGS. 11-16, an additional bag dispenser 80 embodying the present invention, similar to the bag dispensers 10, 60 described above, includes an axle 82 with a generally planar bar 84 having an elongated slot 86 through which the bags 18 are individually removable from the roll 16. The bar 84 extends between first and second bag roll retaining flanges 88, 90 in spaced relation to the axle 82. The first and second bag roll retaining flanges 88, 90 are generally perpendicular to and extend from an exterior surface of the axle 82. The first and second bag roll retaining flanges 88, 90 align the roll 16 with the elongated slot 86 as the roll 16 rotates. The axle 82 is otherwise identical to the axle 12 described above and includes a plurality of interior annular rings (not shown) which engage the stop 24 of the rod 20.

The roll 16 of bags 18 is adhesively connected to the axle 12, 82. A piece of tape 92 or the like connects an end of a first bag 18 on a new roll 16 to the roll 16. The tape 92 is removed and the first bag 18 is threaded through the slot 86 to place the dispenser 80 in condition for use. One side of each bag 18 includes a releasable dry adhesive 94 for adhering to another side of at least one bag 18 in the roll 16 of plastic bags 18. The adhesive 94 assists the bags 18 in maintaining cohesiveness as a roll 16 and prevents the roll 16 from unwinding during use of the dispenser 10, 60, 80.

In use, fifteen or so plastic bags 18 are wound about the axle 12 to form the roll 16. A replacement roll 16 may include bags 18 pre-wound about an axle 12 which replaces the bag-exhausted axle 12 from the previous roll 16 or new bags 18 can be wound about the axle 12 used for the previous roll 16. Either way, the cap 44 and rod 20 are removed from the housing 38 to place the new roll 16 within the inner cavity 40 if a housing 38 is used. If no housing 38 is used, then the cap 44 and rod 20 are simply disengaged from the bag-exhausted axle 12. The axle 12 is either engaged to the rod 20 or placed into the housing 38 and the rod 20 engaged to the axle 12 as the cap 44 is placed onto the housing 38. If a bag roll retainer 62 is used, the bag roll retainer 62 can be connected to the axle 12 at any point during this process. The end bag 18 of the roll 16 may then be accessed through the housing aperture 42 and withdrawn from the housing 38 as desired. The entire roll 16 of plastic bags 18 disposed on the axle 12 will rotate within the housing 38 as the bags 18 are withdrawn therefrom. The bags 18 are preferably releasably attached to one another such that one bag 16 may be easily separated from another after being withdrawn from the dispenser 10, 60, 80 yet the bags 16 are sufficiently attached to one another to prevent such separation as they are being withdrawn from the dispenser 10, 60, 80.

Figure 17:
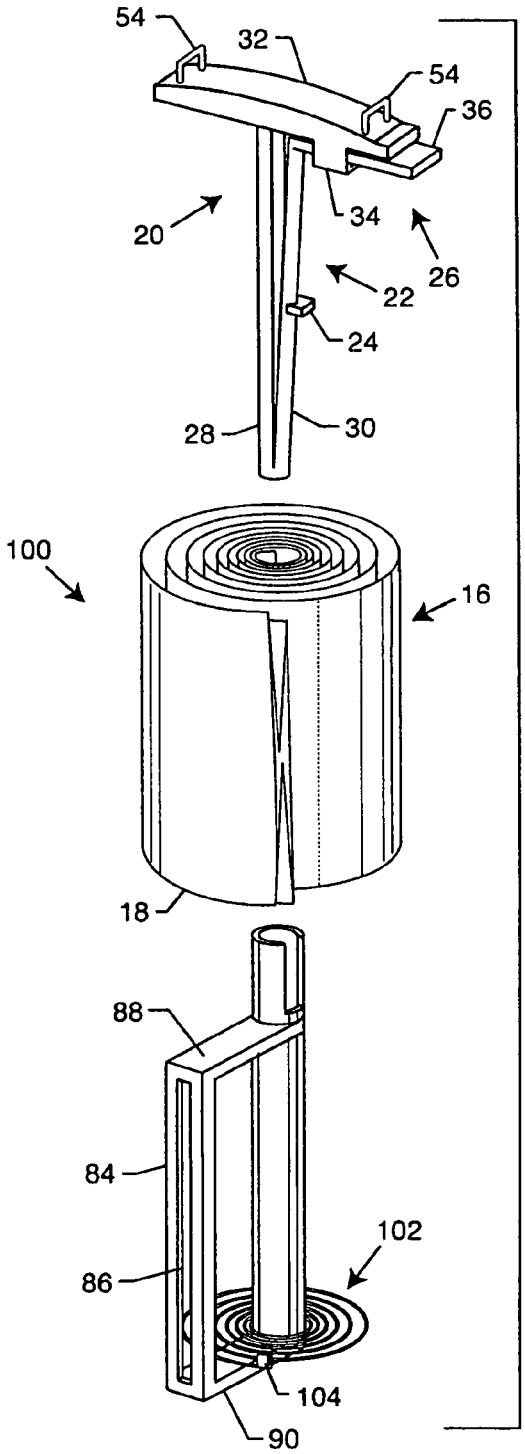
FIG. 17 is an exploded front perspective view of a bag dispenser embodying the present invention that is similar to the bag dispenser of FIG. 11 but also includes a bag guide.
Figure 18:
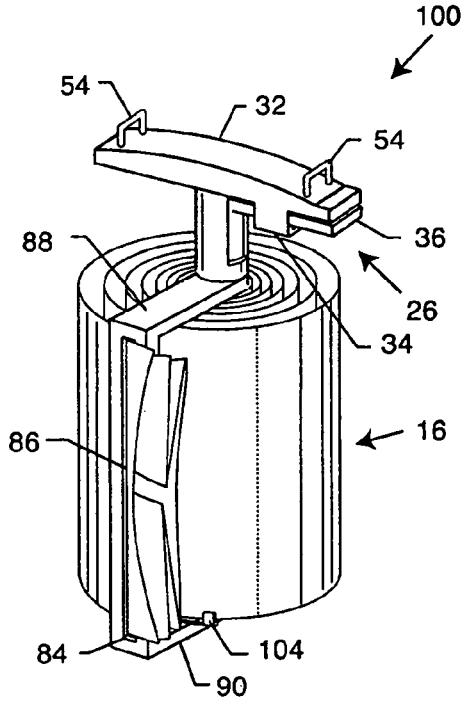
FIG. 18 is a front perspective view of the bag dispenser of FIG. 17 shown with the roll of bags threaded through an elongated dispensing slot.

Another bag dispenser 100 embodying the present invention, seen in FIGS. 17 and 18 and similar to the bag dispenser 80 described above, includes a coiled guide 102 disposed above and adjacent to the second bag roll retaining flange 90. The guide 102 may be made of a variety of materials including, without limitation, metal or plastic. The guide 102 limits radially outward expansion of the roll 16 of bags 18 as the roll 16 of bags 18 unwinds. A retainer flange 104 at an end of the guide 102 abuts against the exterior of the roll 16 and limits the outward expansion of the roll 16. The roll 16 of bags 18 used with this dispenser 100 may or may not use adhesive 94 to help maintain cohesiveness of the bags 18 as a roll 16.

The bag dispensers 10, 60, 80, 100 and their various components may be made of a variety of materials including, without limitation, metal or plastic.

The bag dispenser 10, 60, 80, 100 is intended to be utilized in connection with a collar, harness or a leash device (not shown) commonly utilized when walking one's pet. The bag dispenser 10, 60, 80, 100 may also be attached to a key chain (not shown) or the like. The leash device may be simple leather or chain leash or a leash device that incorporates a retractable leash that extends from a housing.

Although several embodiments have been described in detail for purposes of illustration, various modifications may be made without departing from the scope and spirit of the invention.

What is claimed is:

1. A bag dispenser, comprising:

an axle having an interiorly facing annular ring;

a roll of bags disposed about the axle; and a rod removably inserted into the axle and having a stop that is movable toward the center of the axle and past the annular ring during insertion and thereafter engages the annular ring to connect the rod to the axle, wherein the rod includes resilient means for selectively disengaging the stop from the annular ring to move the stop past the annular ring.

2. A bag dispenser, comprising:

an axle having a plurality of spaced-apart interior annular rings;

a roll of bags wound about the axle; and a rod removably inserted into the axle, the rod having a base shaft, a resilient lever, a stop extending from one side of the resilient lever for engaging at least one of the annular rings to connect the rod to the axle, and means for selectively disengaging the stop from the annular rings to disconnect the rod from the axle; wherein the stop automatically engages at least one of the annular rings as the rod is inserted into the axle, and the axle is rotatable about the rod.

3. The bag dispenser of claim 2, the means for selectively disengaging the annular rings including an end of the resilient lever and a flange at one end of the rod, the flange having a bracket for retaining the end of the resilient lever.

4. The bag dispenser of claim 2, including a bag roll retainer connected to an end of the axle, the bag roll retainer including an axle guide extending into the axle.

* * * * *